US010010910B1

(12) United States Patent
Stover

(10) Patent No.: US 10,010,910 B1
(45) Date of Patent: Jul. 3, 2018

(54) PORTABLE PROSPECTING AND CLASSIFYING SELF-CONTAINED APPARATUS

(71) Applicant: Ricky Dean Stover, Three Forks, MT (US)

(72) Inventor: Ricky Dean Stover, Three Forks, MT (US)

(73) Assignee: Ricky Dean Stover, Three Forks, MT (US)

( * ) Notice: Subject to any disclaimer, the term of this patent is extended or adjusted under 35 U.S.C. 154(b) by 0 days.

(21) Appl. No.: 15/917,618

(22) Filed: Mar. 10, 2018

(51) Int. Cl.
*B07B 1/04* (2006.01)
*B07B 1/02* (2006.01)

(52) U.S. Cl.
CPC ..... *B07B 1/02* (2013.01); *B07B 2201/04* (2013.01)

(58) Field of Classification Search
CPC .... B07B 1/02; B07B 1/28; B07B 1/36; B07B 2201/04
USPC ..... 209/274, 311, 355, 359, 404, 405, 417, 209/420
See application file for complete search history.

(56) References Cited

U.S. PATENT DOCUMENTS 1,488,930 A * 4/1924 Mannix ..... A47L 13/50 15/264
4,101,419 A 7/1978 Bergman
4,592,833 A 6/1986 Perdue
5,423,430 A * 6/1995 Zaffiro ..... B07B 1/02 209/315
5,927,509 A 7/1999 Lord
8,113,355 B1 * 2/2012 Peterson ..... B03B 5/02 209/235
8,646,614 B2 * 2/2014 Peterson ..... B03B 5/02 209/233
9,095,881 B2 * 8/2015 Rieck ..... B07B 1/28
9,132,452 B2 * 9/2015 Trivette ..... B03B 5/02
9,610,613 B2 * 4/2017 Rieck ..... B07B 1/02
2012/0037634 A1 * 2/2012 Kiceniuk, Jr. ..... B44D 3/121 220/495.02
2016/0108555 A1 * 4/2016 Rosado ..... B07B 1/02 209/409

* cited by examiner

*Primary Examiner* — Terrell Howard Matthews
(74) *Attorney, Agent, or Firm* — MacBride Law, PLLC; William L. MacBride, Jr.

(57) ABSTRACT

The invention is a portable prospecting and classifying self-contained apparatus having a bucket, a supporting classifier screen and a supported classifier screen setting freely within the bucket, having a bucket handle and a bucket lid closing securely over the bucket. The supported classifier screen has a screen mesh and a screen handle, allowing the user to lift the supported classifier screen from the bucket. The supporting classifier screen has a screen mesh which may be of a finer mesh than the supported screen mesh and a supporting classifier frame. A prospector uses the portable prospecting and classifying self-contained apparatus invention by scooping or pouring mineral material into the bucket with an earth digging scoop or gold pan. The supported classifier screen and the supporting classifier screen are adapted to classify and separate mineral material from coarse to finer grain material when poured into the bucket.

16 Claims, 6 Drawing Sheets

PORTABLE PROSPECTING AND CLASSIFYING SELF-CONTAINED APPARATUS

FIELD OF THE INVENTION

This application relates to a portable prospecting and classifying self-contained apparatus, kit or assembly useful for exploring, hunting or prospecting for gold and other minerals and for wet or dry classifying, and separating them from other earthen materials located in detrital or placer ground, having classifying screens or meshes contained in a portable bucket. The portable prospecting and classifying self-contained apparatus of the present invention is particularly adapted for portable mobility so that the entire apparatus may be easily hand transported to multiple locations for prospecting in dirt detrital or placer ground.

BACKGROUND OF THE INVENTION

Detrital or placer mining of minerals, particularly for gold and other precious gems and minerals, is historically well known. The activity has been pursued by artisans, hobbyists and professional prospectors and explorers. Such prospecting activity for gold and other minerals requires various pieces of specialized equipment, such as scoops, screens, "gold" pans, etc. There are a number of scoops, concentrating pans and meshes, sieves or screens available on the market. The prospecting and classifying apparatus of the present invention is built and designed for convenience for ground tests and for new prospecting or exploring.

In general, the prospecting operation provides classifying screens that allow classification or separation of higher density metal values such as particles of gold from a mixture of gold particles and earthen or other mineral material through the use of screen meshes of varying fineness. A load of mineral material, including dirt and other mineral material may be loaded into a bucket so that particulates small enough to fall though the holes or mesh in the classifying or separator assembly of one or more screens may fall through, leaving coarser material behind.

There has been a recognized need for assembling and using prospecting tools in a manner to make prospecting easier and more convenient, similar to the convenience of a compact tool. There is no known technology being used to solve the problem of assembling and transporting the prospecting tools in an assembled, convenient and compact manner as with the present invention, keeping the component tools readily available and together for use in prospecting.

As well, there has been no device to solve the problem of the prospector or explorer, particularly when traveling on foot, of having a lot of different pieces of prospecting and classifying equipment to carry at one time. Finally, there is a need to be able to keep all of the mineral residual together during storage and transportation and minimizing the amount of equipment needed to accomplish this task.

The prospecting and classifying devices described in the related art do not disclose features of the present invention and would not be as suitable for the required purpose of the present invention hereinafter described. Prospecting and classifying devices are well known in the related art, exemplified by U.S. Pat. No. 9,132,452 to Trivette et al ("Trivette"); U.S. Pat. No. 5,423,430, to Zaffiro et al. ("Zaffiro"); U.S. Pat. No. 4,101,419 to Bergman ("Bergman"); and U.S. Pat. No. 8,113,355 to Peterson ("Peterson"). Bergman discloses a separator kit, a stand alone kit so that conventional classifying tools can be carried in a single unit. Zaffiro discloses a 'rocker" gold recovery kit with a bucket and stacking screens, and shows that it is known to provide a bucket with several nestable classifying screens and a separator mechanism interior of the bucket with handles. Trivette discloses a classifier assembly with the assembly designed to fit inside a bucket, and shows nestable classifier screen and mesh trays. Peterson discloses a classifying kit comprised of bucket, sieves and bowl, among other elements and provides a nestable classifier screen and mesh trays, adapted for both wet and dry classifying. However, none of the known devices disclose or suggest all the features of the present invention in the same arrangement.

The mechanism and elements of the present invention (the supports, bucket notches, etc., set forth herein) for nesting the screen and mesh components are not found in the related art. Zaffiro and Trivette provide specific approaches to adapt various classifier components for readily nesting the screens with a bucket, teaching away from the elements and mechanism of the present invention.

None of the references contain every feature of the present invention, and none of these references in combination disclose, suggest or teach every feature of the present invention.

The foregoing and other objectives, advantages, aspects, and features of the present invention will be more fully understood and appreciated by those skilled in the art upon consideration of the detailed description of a preferred embodiment, presented below in conjunction with the accompanying drawings.

SUMMARY OF THE INVENTION

The present invention is a portable prospecting and classifying self-contained apparatus comprising a bucket, a supporting classifier screen or sieve, and a supported classifier screen setting or resting freely removably and snugly within the bucket. The bucket comprises a bucket top edge, an opposing bottom edge, a bucket handle, a bucket bottom, and a bucket lid engaging and closing securely over the bucket top edge. The bucket lid and the bucket handle cooperatively engage the bucket in any standard manner as commonly found in the industry. The present invention is easily transported, lightweight and durable. It is simple to use and inexpensive to produce and purchase. It is lightweight, making it affordable to ship.

The supported classifier screen comprises a supported screen mesh, a supported screen top edge, and a screen handle cooperatively attached to the supported classifier screen proximal to the supported screen top edge. The screen handle allows the user to lift the supported classifier screen from the bucket. The supporting classifier screen comprises a supporting screen top edge, a supporting screen mesh which may be of a finer mesh than the supported screen mesh, and a supporting classifier frame. The supporting screen classifier screen, supporting screen mesh, supported classifier screen, and supported screen mesh may be any number of mineral classifying screens and mesh commonly found in the mining and prospecting industry. The supporting classifier frame comprises a plurality of support bars spaced equidistant along the supporting screen top edge, each of the plurality of support bars extending substantially vertically and slightly angling from, the supporting screen top edge at a connecting point end outwardly to an opposing support, hook free end. The supporting classifier frame further comprises midway along each of its plurality of support bars a supporting frame support bracket, or ledge, each supporting frame support bracket projecting inward to the bucket from its respective one of the plurality of support bars.

The bucket further comprises a plurality of bucket notches spaced equidistant along the bucket top edge in order to securely and freely accommodate, install and fit the respective and co-located each of the plurality of support bars at a respective opposing support hook free end. The plurality of bucket notches have the same number as the plurality of support bars and are spaced equidistant along the bucket top edge at the same spacing as the plurality of support bars and in the same elevational location as the opposing support hook free end to each of the respective plurality of support bars in order for the opposing support hook free end to each of the plurality of support bars to locatingly match and fit within the plurality of bucket notches.

An artisan or hobby gold prospector or a professional mineral explorer uses the portable prospecting and classifying self-contained apparatus of the present invention by scooping or shoveling mineral material, including minerals, granular material, clay, alluvium, placer material, dirt, earth, mineral waste or other earthen material, with an earth digging scoop, or shovel or other such shoveling or digging tools, into the bucket. The supported classifier screen and the supporting classifier screen are adapted to receive and to sequentially classify and separate the mineral material from coarse to finer grain material when the mineral material is poured into the bucket through the supported classifier screen and then through the supporting classifier screen to the bucket bottom, and may be transported thereby, for further analysis. The portable prospecting and classifying self-contained apparatus classifies and separates the mineral material including mineral and other earthen material that the user scoops from a location with the earth digging scoop and/or obtains in a placer activity with a gold pan during the user's prospecting or exploring for minerals.

In an alternatively embodiment of the present invention, the portable prospecting and classifying self-contained apparatus comprises the bucket, at least one classifier screen comprising a classifier mesh, and a screen handle for each of the at least one classifier screen, and the at least one classifier screen nesting freely, removably, and snugly within the bucket, and a free supporting frame. The classifier screen mesh for each at least one classifier screen is increasingly finer in mesh fineness vertically within the bucket from the bucket top edge.

The free supporting frame comprises a horizontal support beam and a plurality of support bars spaced equidistant along an inside circumference of the bucket. The horizontal support beam is located midway along and attaching to the plurality of support bars. The bucket further comprises a plurality of free support attaching means spaced equidistant along the bucket top edge in order to securely attach and freely accommodate each respective and co-located opposing free support end. The free support attaching means may be any number of means to securely attach the opposing free support ends, including fittings within the bucket, including clamps to secure the plurality of support bars. The at least one classifier screen in the alternative embodiment of the present invention is adapted to receive, and sequentially classifies and separates mineral material when the mineral material is poured into the bucket during the prospecting activity. The finest grained material percolates or separates through each of the at least one classifier screens to the bucket bottom, and may be transported thereby, for further analysis.

The aforementioned features, objectives, aspects and advantages of the present invention, and further objectives and advantages of the invention, will become apparent from a consideration of the drawings and ensuing description.

BRIEF DESCRIPTION OF THE SEVERAL VIEWS OF THE DRAWINGS

The foregoing features and other aspects of the present invention are explained and other features and objects of the present invention will become apparent in the following detailed descriptions, taken in conjunction with the accompanying drawings. However, the drawings are provided for purposes of illustration only, and are not intended as a definition of the limits of the invention.

FIG. 3A illustrates a perspective view of a carabineer;

FIG. 3B illustrates a perspective view of an earth digging scoop; and

FIG. 3C illustrates a perspective view of a gold pan.

FIG. 4A illustrates an elevational cross sectional view of a supported classifier screen in cross section, along line A-A' located in FIG. 6;

FIG. 4B illustrates an elevational cross sectional view of a supporting classifier screen in cross section, along line A-A' located in FIG. 6; and FIG. 4C illustrates an elevational cross sectional view of a bucket and bucket lids in cross section along line A-A' as located in FIG. 6.

DETAILED DESCRIPTION OF THE INVENTION

The present invention will now be described more fully hereinafter with references to the accompanying drawings, in which the preferred embodiment of the invention is shown. This invention, however, may be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout.

Figure 1:
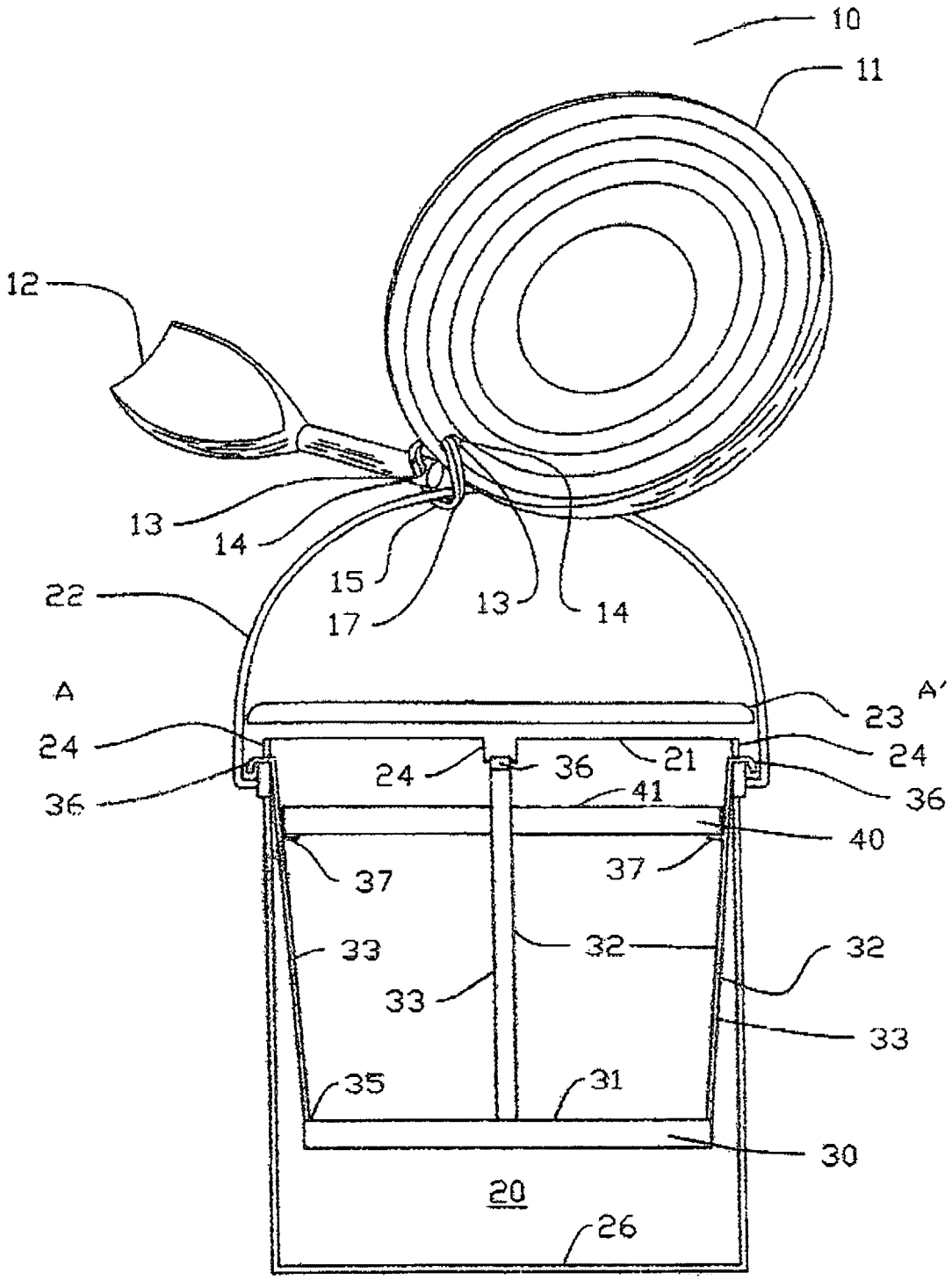
FIG. 1 illustrates a cross sectional elevation view of one embodiment of the present invention, depicting elements of the portable prospecting and classifying self-contained apparatus showing a bucket, a bucket lid, a supported screen mesh and a supporting screen mesh, among other elements, in cross section along line A-A' located in FIG. 6; as well as a gold pan, an earth digging scoop and a carabineer attached to the bucket in perspective view.

Turning now in detail to the drawings in accordance with the present invention, one embodiment of the present invention is depicted in FIG. 1, a cross sectional elevation view, and 2, an exploded cross sectional elevation view, of a portable prospecting and classifying self-contained apparatus 10, comprising a bucket 20, a supporting classifier screen 30 or sieve, and a supported classifier screen 40 or sieve. Both the supporting classifier screen 30 and the supported classifier screen 40 nest, set or rest, freely removably and snugly within the bucket 20, and are thereby easily removable from the bucket 20.

As shown in FIGS. 1, 2, 4, 5, and 6 (FIG. 6 being a perspective view showing the location of cross section line A-A' for the cross sectional elevational views of FIGS. 1, 2, 4, and 5), the bucket 20 comprises a bucket top edge 21, an opposing bottom edge 26, a bucket handle 22 (FIG. 1) attaching to and engaging the bucket 20 proximal to the bucket top edge 21, a bucket bottom 27 (FIG. 6), and a bucket lid 23 engaging and closing securely over the bucket top edge 21. See FIGS. 1 and 5, in particular for these elements. The bucket 20 may be any size found in the industry, large enough to accommodate the supporting classifier screen 40 and the supported classifier screen 40, including, but not limited to, a commonly used 5 gallon paint bucket. The bucket 20 may be made of any lightweight, durable and resilient material, including hard plastic or aluminum. The bucket lid 23 and the bucket handle 22 cooperatively engage the bucket 20 in any standard manner as commonly found in the industry by buckets, so that the bucket lid 23 fits snugly on and/or over the bucket top edge 21, and the handle allows for easy hand transport of the bucket 20 by a user 16, shown in FIGS. 5 and 6.

Figure 2:
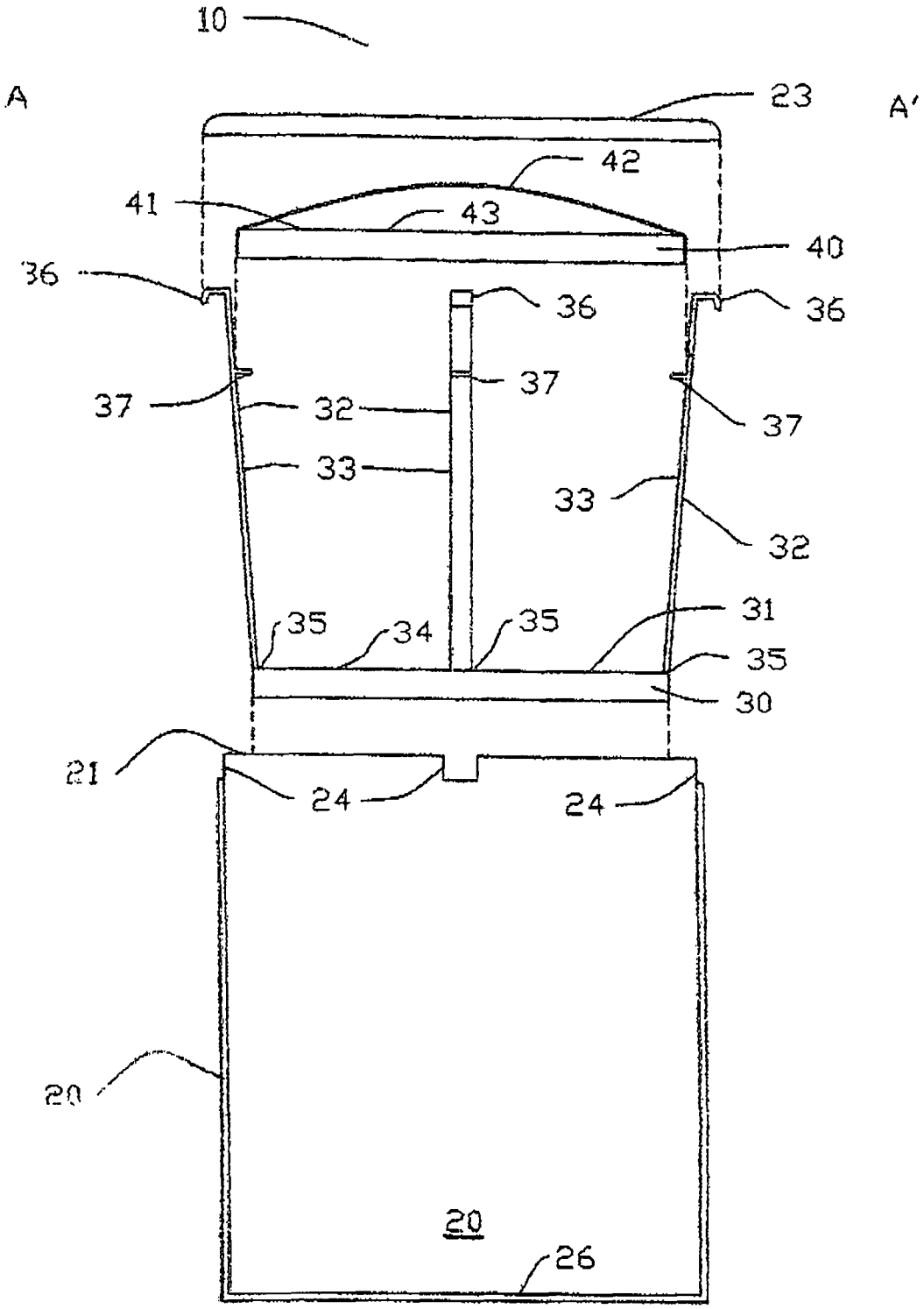
FIG. 2 illustrates an exploded, cross sectional elevation view of one embodiment of the present invention in cross section along line A-A' located in FIG. 6.

In another embodiment of the present invention, the bucket 20 may be tapered to the opposing bottom edge 26, in the manner of the supporting classifier frame 32 in FIG. 2.

Figure 6:
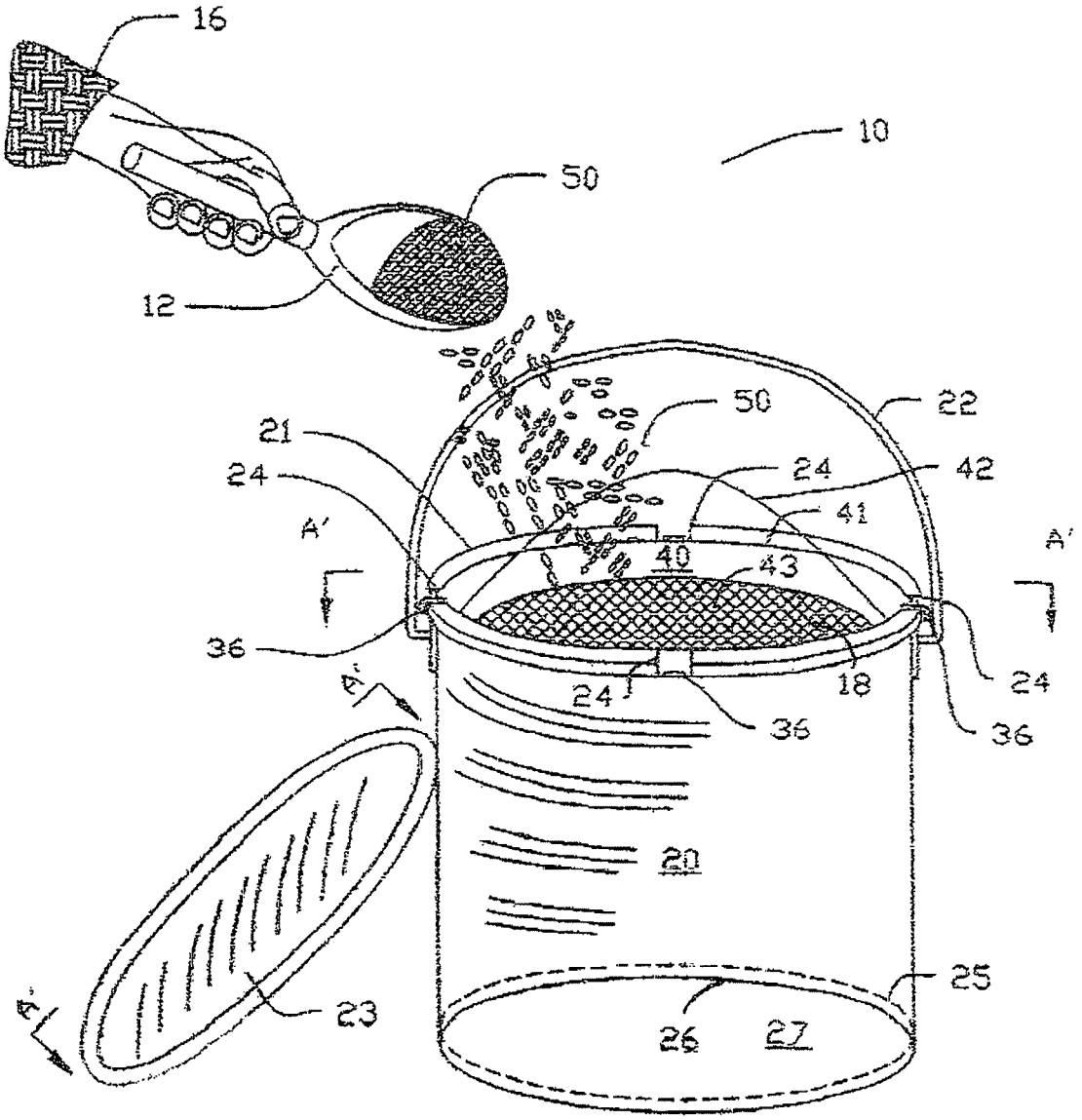
FIG. 6 illustrates a perspective view an embodiment of the present invention, depicting a user pouring mineral or dirt material into the bucket, the bucket having at least one classifier screen, and showing the location of cross section line A-A' for the bucket and bucket lid and the general configuration of the inside circumference to the bucket as a dotted line.

As shown in FIGS. 1, 2 and 6, the supported classifier screen 40 comprises a supported screen mesh 43 (FIG. 6), a supported screen top edge 41 and a screen handle 42 cooperatively attached to the supported classifier screen 40 proximal to the supported screen top edge 41. The screen handle 42 allows the user 16 to lift the supported classifier screen 40 from the bucket 20. The supporting classifier screen 30 comprises a supporting screen top edge 31, a supporting screen mesh 34 which may be of a finer mesh than the supported screen mesh 43 and a supporting classifier frame 32. FIG. 2 depicts, generally, the supporting screen mesh 34 and/or the supported screen mesh 43. The supporting screen classifier screen 30, supporting screen mesh 34, supported classifier screen 40 and supported screen mesh 43 may be any number of mineral classifying screens and mesh commonly found in the mining and prospecting industry.

As shown in FIGS. 1 and 2, the supporting classifier frame 32 comprises a plurality of support bars 33 spaced equidistant along the supporting screen top edge 31, each of the plurality of support bars 33 extending substantially vertically and slightly angling outwardly from, the supporting screen top edge 31 at a connecting point end 35 to an opposing support hook free end 36 and toward the bucket top edge 21. The supporting classifier frame 32 further comprises midway along each of its plurality of support bars 33 a supporting frame support bracket 37, or ledge, each supporting frame support bracket 37 projecting inward to the bucket 20 from its respective one of the plurality of support bars 33. The supporting classifier frame 32 may be made, as well, of any lightweight, durable and resilient material, including hard plastic or aluminum, consistent with the materials in which the supporting classifier screen 30 is made to ensure a secure connection to each other.

Figure 5:
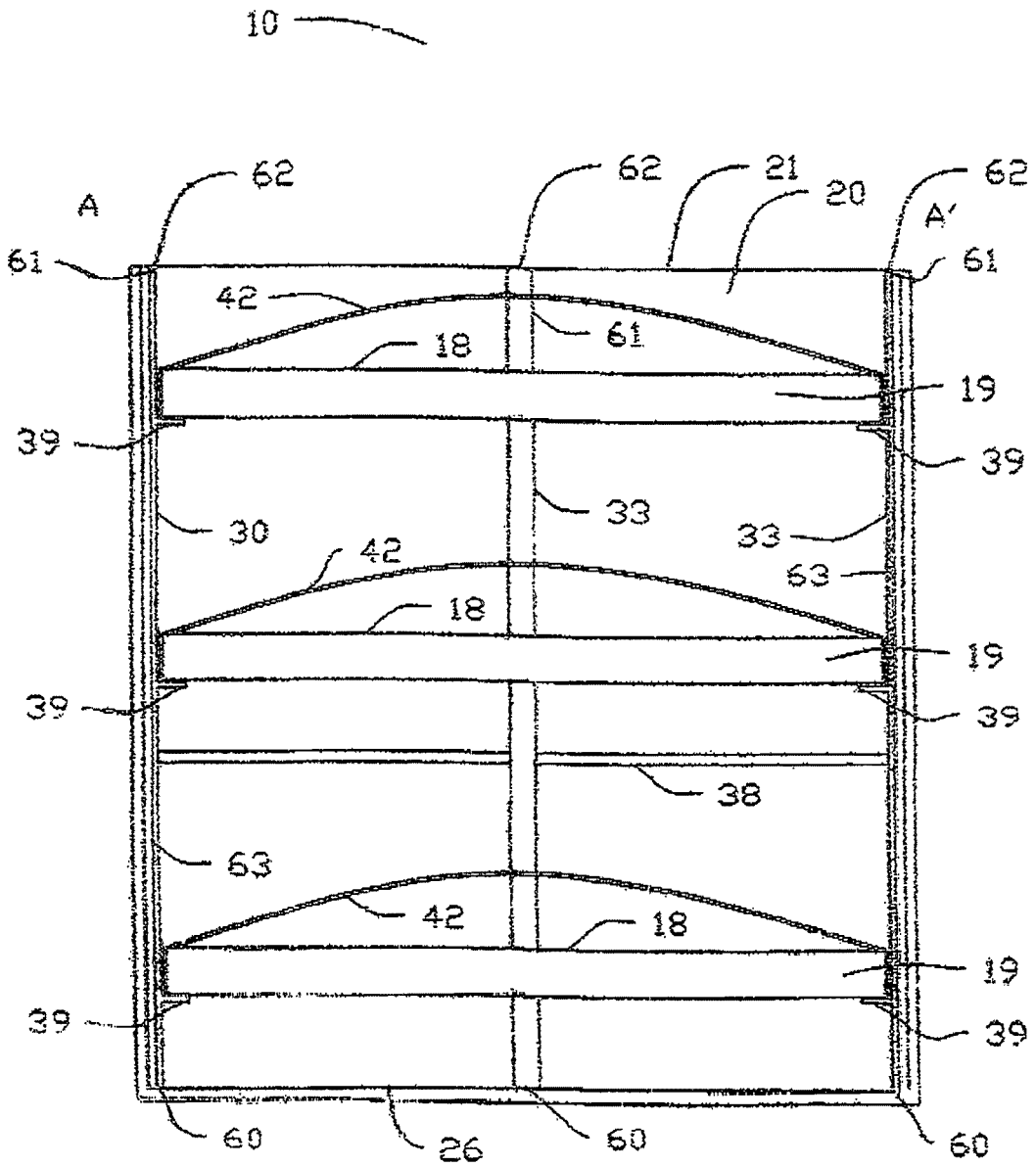
FIG. 5 illustrates a cross sectional elevation view of an alternative embodiment of the present invention, showing at least one classifier screen in the bucket, in cross section along line A-A' located in FIG. 6.

The bucket 20 further comprises a plurality of bucket notches 24, as depicted in FIGS. 1, 2 and 5, spaced equidistant along the bucket top edge 21 in order to securely and freely accommodate, install and fit the respective and co-located each of the plurality of support bars 33 at a respective opposing support hook free end 36. In this manner, therefore, the plurality of bucket notches 24 have the same number as the plurality of support bars 33 and are spaced equidistant along the bucket top edge 21 at the same spacing as the plurality of support bars 33 and in the same elevational location as the opposing support hook free end 36 to each of the respective plurality of support bars 33 in order for the opposing support hook free end 36 to each of the plurality of support bars 33 to locatingly match and fit within the plurality of bucket notches 24, as depicted in FIGS. 1, 2 and 5. Each opposing support hook free end 36 faces outwardly, toward the outside of the bucket 20, enabling it to securely fit withing the respective plurality of bucket notches 24.

Alternatively, other elements for attaching the plurality of support bars 33 may be used, including fittings on the end the plurality of support bars 33 in alternative embodiments of the present invention.

Figure 4C:
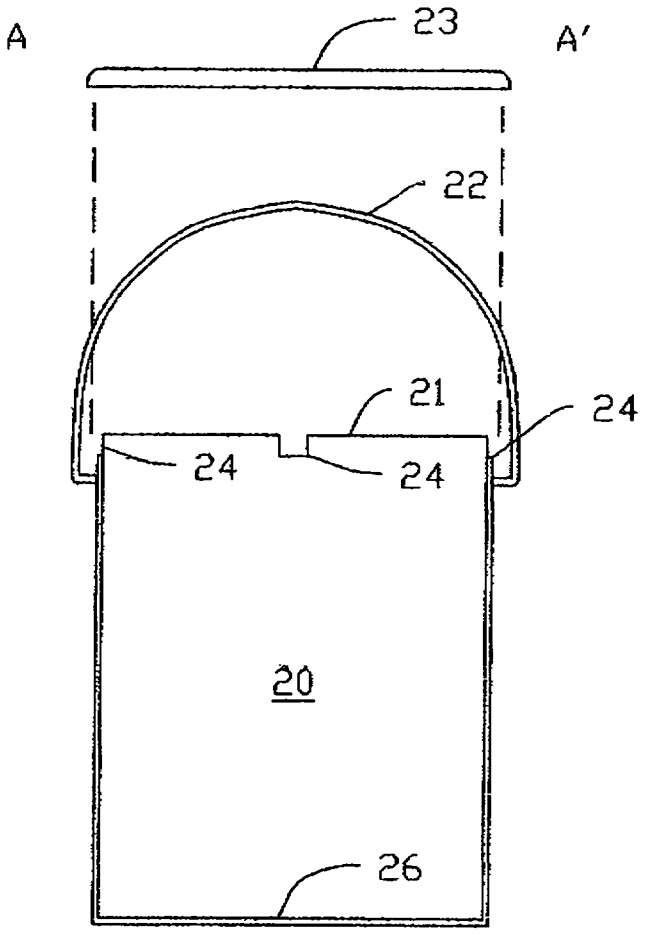
FIGS. 4A-4C illustrates a series of detailed perspective views of particular elements of the bucket and elements contained and transported therein in one embodiment of the present invention, as follows.
Figure 4A:
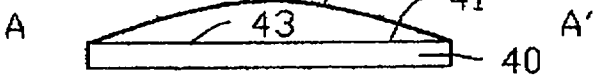
Figure 4B:
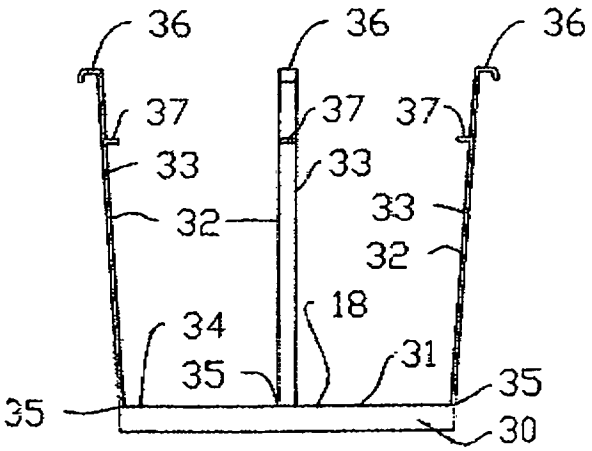

The supporting frame support bracket 37 to the respective each of the plurality of support bars 33 provides secure support and nesting for the supported classifier screen 40 within the supporting classifier frame 32 of the supporting classifier screen 30 and within the bucket 20, as shown in FIGS. 1, 2 and 4B. The supporting classifier frame 32 thereby allows the supporting classifier screen 30 to nest freely and midway within the bucket 20, and the supported classifier screen to nest freely and proximally to the bucket top edge 21. The supporting frame support brackets 37 are located in a manner to cause the supported screen top edge 41 to be located flush with the bucket top edge 21.

Figure 3A:
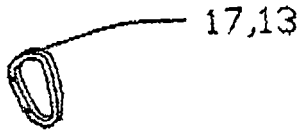
FIGS. 3A-3C illustrates a series of detailed perspective views of particular elements of one embodiment of the present invention, as follows.
Figure 3B:
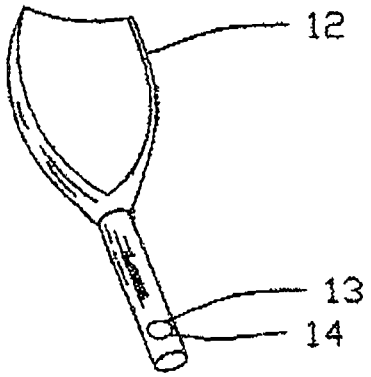
Figure 3C:
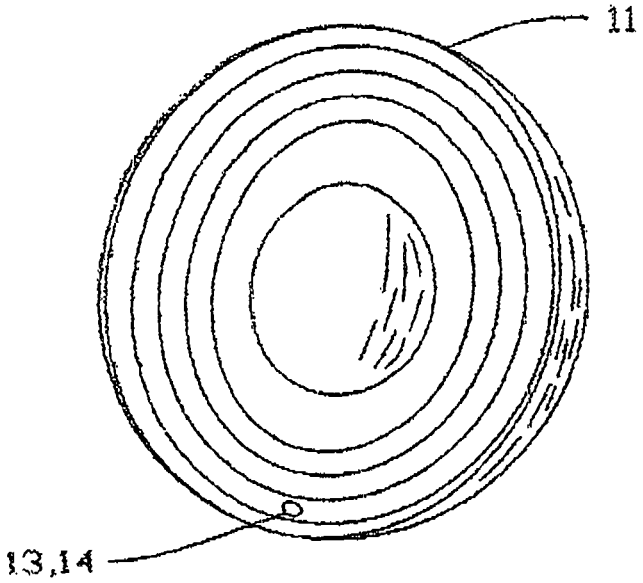

In the manner described immediately above and depicted in FIGS. 1, 2 and 4C, the supported classifier screen 40 is located in the bucket 20 above the supporting classifier screen 30. As a user 16, including an artisan or hobby gold prospector or a professional mineral explorer, uses the portable prospecting and classifying self-contained apparatus 10 of the present invention, for example, by scooping or shoveling mineral material 50, including minerals, granular material, clay, alluvium, placer material, dirt, earth, mineral waste or other earthen material, with an earth digging scoop 12, or shovel or other such shoveling or digging tool, into the bucket 20, as depicted in FIGS. 2, 3B, and 6; the supported classifier screen 40 and the supporting classifier screen 30 adapted to receive and to sequentially classify and separate the mineral material 50 from coarse to finer grain mineral material 50 when the mineral material 50 is poured into the bucket 20. The finest grained mineral material 50 percolates or separates through the supported classifier screen 40 and then through the supporting classifier screen 30 to the bucket bottom 27 of the bucket 20, for further analysis by the user 16. The portable prospecting and classifying self-contained apparatus 10 of the present invention in this process classifies and separates the mineral material 50. The mineral material 50 includes the mineral and other earthen material that the user 16 scoops from a location with the earth digging scoop 12 and/or obtains in a placer activity with a gold pan 11 and pours into the bucket 20, during the user's 16 prospecting or exploring for minerals. The term "gold pan" 11 here is used as a general term characterizing any similar panning tool utilized for collecting, panning and separating mineral material 50 by the use of water. Such mineral material 50 of value to the user, also includes gold and/or other precious gems and minerals, or non or semi precious minerals or gems or base or industrial minerals. Water may be included with the mineral material 50, as well as the gold pan 11, or within the bucket 20 to facilitate the classifying process.

As shown in FIGS. 2 and 6, the bucket handle 22, for transporting the bucket 20 by hand, and the bucket lid 23, for covering and securing the contents of the bucket 20, allow the bucket 20 containing the supporting classifier screen 30, the supported classifier screen 40 and the mineral material 50 to be securely and compactly transported. In this manner, the bucket 20, being securely and compactly transported, provides the portable prospecting and classifying self-contained apparatus 10, for use by the user 16 at various prospecting locations, including alluvial, detrital or placer deposits, manmade mineral waste deposits or other locations of mineral material 50 at which the user 16 may gather the mineral material 50.

The portable prospecting and classifying self-contained apparatus 10 further comprises the gold pan 11 and the earth digging scoop 12, referenced above, and as shown in FIGS. 1, 3A-C, and 6. The gold pan 11 and the earth digging scoop 12 are each adapted with or having a tool attaching means 13 for attaching the gold pan 11 and the earth digging scoop 12 to the bucket handle 22, allowing easy transport of the gold pan 11 and the earth digging scoop 12 with the bucket 20 in a self-containing manner. The gold pan 11 and the earth digging scoop 12 are thereby securely and compactly transported with the bucket 20. The tool attaching means 13 may be any number of attaching elements commonly known, including clips, hooks or other attaching means. The tool attaching means 13 may comprise, in one alternative of the present invention, an attachment hole 14, in the gold pan 11 and in the earth digging scoop 13, as shown in FIGS. 1 and 3A-3C. For further ease of transport by the user 16, the portable prospecting and classifying self-contained apparatus further comprises an apparatus attaching means 15 for attaching the gold pan 11 and the earth digging scoop 13 to the bucket handle 22 at the tool attaching means 13. This apparatus attaching means 15 may attach in any manner to the bucket handle 22, or be adapted as a part of an alternative carrying means, including by, toggle, clip, lanyard, rope or strap. In one alternative, the apparatus attaching means 15 comprises a carabineer 17, depicted in FIGS. 1 and 3A, and commonly found with climbing, prospecting and other outdoor gear.

As mentioned, in part above, all of the elements of the portable prospecting and classifying self-contained apparatus 10 comprises lightweight and noncorroding material, including hard plastic, aluminum, or other resilient and lightweight materials.

In an alternative embodiment of the present invention, shown in FIG. 5 (a cross sectional elevation view showing at least one classifier screen 19 in a bucket 20), the portable prospecting and classifying self-contained apparatus 10 comprises the bucket 20, at least one classifier screen 19 comprising a classifier screen mesh 18 (also depicted in FIG. 6) and a screen handle 42 for each of the at least one classifier screen 19, and the at least one classifier screen 19 nesting freely, removably and snugly within the bucket 20, and a free supporting frame 63. Shown in FIGS. 4C and 5, the bucket 20 comprises a bucket top edge 21, an opposing bottom edge 26, a bucket handle 22 attaching to the bucket 20 proximal to the bucket top edge 21, a bucket bottom 27 (in FIG. 6), and a bucket lid 23 closing securely over the bucket top edge 21. The classifier screen mesh 18 for each at least one classifier screen 19 is increasingly finer in mesh fineness vertically within the bucket 20, from the bucket top edge 21.

The free supporting frame 63, shown in FIG. 5 comprises a horizontal support beam 38 and a plurality of support bars 33 spaced equidistant along an inside circumference 25 (depicted in FIG. 6) of the bucket 20, the horizontal support beam 38 located midway along and attaching to the plurality of support bars 33. The free supporting frame 63 sits snugly and securely inside the inside circumference 25 of the bucket 20. FIG. 6 describes the inside circumference 25 of the bucket 20 in terms of a dotted line along the inside circumference 25 at the opposing bottom edge 26 of the bucket 20. As shown in FIG. 5, each of the plurality of support bars 33 extends substantially vertical, slightly angling outwardly from a free bottom end 60 at the opposing bottom edge 26 at the bucket bottom 27 (in FIG. 6) of the bucket 20 to an opposing free support end 61 proximal to the bucket top edge 21. The horizontal support beam 38, in this manner, is located along the inside circumference 25, midway along the plurality of support bars 33 in order to stabilize the plurality of support bars 33.

The bucket 20 in the alternative embodiment of the present invention shown in FIG. 5 further comprises a plurality of free support attaching means 62 spaced equidistant along the bucket top edge 21 in order to securely attach and freely accommodate each respective and co-located opposing free support end 61. The free support attaching means 62 may be any number of means to securely attach the opposing free support ends 61, including fittings within the bucket 20, including clips or clamps to secure the plurality of support bars 33. The free supporting frame 63 further comprises the at least one support bracket 39 midway along each of its plurality of support bars 33, at least one support bracket 39 projecting inward to the bucket 20 from each respective plurality of support bars 33. As shown in FIG. 5, at least one support bracket 39 thereby provides support and nesting for the at least one classifier screen 19 freely within the free supporting frame 63 inside of the bucket 20.

The at least one classifier screen 19 in the alternative embodiment of the present invention shown in FIG. 5 is adapted to receive, and sequentially classifies and separates mineral material 50 when the mineral material 50 is poured into the bucket, by a user 16 during the prospecting activity, as depicted in FIGS. 1 and 6. The finest grained mineral material 50 percolates or separates through each of the at least one classifier screen 19 to the bucket bottom 27 of the bucket 20, for further analysis by the user 16.

As shown in FIGS. 5 and 6, the bucket handle 22 and the bucket lid 21 allow the bucket 20 containing the at least one classifier screen 19 and the mineral material 50 to be securely transported; and whereby the bucket 20, being securely transported, provides the portable prospecting and classifying self-contained apparatus 10 for the user 16 to hand transport and use at prospecting locations as described above. The bucket 20 may be tapered to the opposing bottom edge 26, as discussed above.

The portable prospecting and classifying self-contained apparatus 10 of the alternative embodiment, shown in FIG. 5 principally, and in part in FIGS. 1 and 6, of the present invention, further comprises a gold pan 11 and an earth digging scoop 12, each having or adapted with a tool attaching means 13 for attaching the gold pan 11 and the earth digging scoop 12 to the bucket handle 22. The gold pan 11 and the earth digging scoop 12 in this alternative embodiment of the present invention are securely and compactly transported with the bucket 20, as shown in FIG. 1. The tool attaching means 13 in one alternative comprises an attachment hole 14 (shown in FIG. 1). The portable prospecting and classifying self-contained apparatus 10 further comprises an apparatus attaching means 15 for attaching the gold pan 11 and the earth digging scoop 12 to the bucket handle 22 at the tool attaching means 13, for easy transport as described above. The apparatus attaching means 15 in one alternative comprises a carabineer 17.

The portable prospecting and classifying self-contained apparatus 10, depicted without the gold pan 11 and earth digging scoop 12, in FIG. 5 for the alternative embodiment further comprises lightweight and noncorroding material.

Having thus described in detail a preferred selection of embodiments of the present invention, it is to be appreciated, and will be apparent to those skilled in the art, that many physical changes could be made in the device without altering the invention, or the concepts and principles embodied therein. Unless otherwise specifically stated, the terms and expressions have been used herein as terms of description and not terms of limitation, and are not intended to exclude any equivalents of features shown and described or portions thereof. Various changes can, of course, be made to the preferred embodiment without departing from the spirit and scope of the present invention. The present invention apparatus, therefore, should not be restricted, except in the following claims and their equivalents.

I claim:

1. A portable prospecting and classifying self-contained apparatus comprising:

(a) a bucket comprising: a bucket top edge and an opposing bottom edge, a bucket handle attaching to and cooperatively engaging the bucket proximal to the bucket top edge, a bucket bottom, and a bucket lid engaging and closing securely over the bucket top edge;

(b) a supporting classifier screen and a supported classifier screen, both the supporting classifier screen and the supported classifier screen nesting freely, removably and snugly within the bucket;

(c) the supported classifier screen comprising: a supported screen mesh, a supported screen top edge and a screen handle cooperatively attached to the supported classifier screen proximal to the supported screen top edge;

(d) the supporting classifier screen comprising: a supporting screen top edge, a supporting screen mesh finer than the supported screen mesh, and a supporting classifier frame, the supporting classifier frame comprising: a plurality of support bars attachedly spaced equidistant along the supporting screen top edge, each of the plurality of support bars extending substantially vertically, slightly angling outwardly from the supporting screen top edge at a connecting point end to an opposing support hook free end and toward the bucket top edge;

(e) the bucket further comprising a plurality of bucket notches spaced equidistant along the bucket top edge securely and freely accommodating the respective and co-located and matching opposing support hook free end of each of the plurality of support bars;

(f) the supporting classifier frame further comprising midway along each of its plurality of support bars a supporting frame support bracket, each supporting frame support bracket projecting inward to the bucket from its respective one of the plurality of support bars;

(g) the supporting frame support bracket connected to each of the plurality of support bars providing secure support and nesting for the supported classifier screen within the supporting classifier frame of the supporting classifier screen within the bucket;

(h) the supporting classifier frame thereby allowing the supporting classifier screen to nest freely and midway within the bucket, and the supported classifier screen to nest freely and proximally to the bucket top edge, the supported screen top edge locating flush with the bucket top edge;

(i) the supported classifier screen and the supporting classifier screen adapted for receiving and sequentially classifying and separating mineral material when the mineral material is poured into the bucket;

(j) the bucket handle and the bucket lid allowing the bucket containing the supporting classifier screen, the supported classifier screen and the mineral material to be securely and compactly transported; and (k) whereby the bucket being securely and compactly transported provides the portable prospecting and classifying self-contained apparatus.

2. The portable prospecting and classifying self-contained apparatus of claim 1 further comprising:

(a) a gold pan and an earth digging scoop;

(b) the gold pan and the earth digging scoop each adapted with a tool attaching means for attaching the gold pan and the earth digging scoop to the bucket handle; and (c) whereby the gold pan and the earth digging scoop are securely and compactly transported with the bucket.

3. The tool attaching means of claim 2 comprising: an attachment hole.

4. The portable prospecting and classifying self-contained apparatus of claim 1 further comprising:

an apparatus attaching means for attaching the gold pan and the earth digging scoop to the bucket handle at the tool attaching means.

5. The apparatus attaching means of claim 4 comprising: a carabineer.

6. The portable prospecting and classifying self-contained apparatus of claim 1 further comprising: lightweight and noncorroding material.

7. The bucket of the portable prospecting and classifying self-contained apparatus of claim 1 tapering to the opposing bottom edge.

8. The portable prospecting and classifying self-contained apparatus of claim 1 percolating the mineral material through the supported classifier screen and then through the supporting classifier screen to the bucket bottom.

9. A portable prospecting and classifying self-contained apparatus comprising:

(a) a bucket comprising: a bucket top edge, an opposing bottom edge, a bucket handle attaching to the bucket proximal to the bucket top edge, a bucket bottom, and a bucket lid closing securely over the bucket top edge;

(b) at least one classifier screen comprising: a classifier screen, mesh of increasing fineness for each of the at least one classifier screen beginning at the bucket top edge, and a screen handle, the at least one classifier screen nesting freely, removable and snugly within the bucket;

(c) a free supporting frame comprising a horizontal support beam and a plurality of support bars spaced equidistant along an inside circumference of the bucket, the horizontal support beam located midway along and attaching to the plurality of support bars, and the free supporting frame sitting snugly and securely inside the inside circumference of the bucket, and each of the plurality of support bars extending substantially vertically, slightly angling outwardly from a free bottom end at the opposing bottom edge at the bucket bottom of the bucket to an opposing free support end proximal to the bucket top edge;

(d) the bucket further comprising a plurality of free support attaching means spaced equidistant along the bucket top edge securely attaching and freely accommodating the respective and co-located opposing free support end;

(e) the free supporting frame further comprising at least one support bracket midway along each of its plurality of support bars, each at least one support bracket projecting inward to the bucket from its respective plurality of support bars;

(f) each at least one support bracket thereby providing support and nesting for the at least one classifier screen within the free supporting frame inside of the bucket;

(g) the at least one classifier screen adapted for receiving, and sequentially classifying and separating mineral material when the mineral material is poured into the bucket;

(h) the bucket handle and the bucket lid allowing the bucket containing the at least one classifier screen and the mineral material to be securely transported; and (i) whereby the bucket being securely transported provides the portable prospecting and classifying self-contained apparatus.

10. The portable prospecting and classifying self-contained apparatus of claim 9 further comprising:

(a) a gold pan and an earth digging scoop;

(b) the gold pan and the earth digging scoop each having a tool attaching means for attaching the gold pan and the earth digging scoop to the bucket; and (c) whereby the gold pan and the earth digging scoop are securely and compactly transported with the bucket.

11. The tool attaching means of claim 10 comprising: an attachment hole.

12. The portable prospecting and classifying self-contained apparatus of claim 9 further comprising:

an apparatus attaching means for attaching the gold pan and the earth digging scoop to the bucket handle at the tool attaching means.

13. The apparatus attaching means of claim 12 comprising: a carabineer.

14. The portable prospecting and classifying self-contained apparatus of claim 9 further comprising: lightweight and noncorroding material.

15. The bucket of the portable prospecting and classifying self-contained apparatus of claim 9 tapering to the opposing bottom edge.

16. The portable prospecting and classifying self-contained apparatus of claim 9 percolating the mineral material through the at least one classifier screen to the bucket bottom.

* * * * *